US008366494B2

(12) United States Patent
Nishide

(10) Patent No.: US 8,366,494 B2
(45) Date of Patent: Feb. 5, 2013

(54) TERMINAL FITTING

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 20 days.

(21) Appl. No.: 13/080,208

(22) Filed: Apr. 5, 2011

(65) Prior Publication Data

US 2011/0250805 A1 Oct. 13, 2011

(30) Foreign Application Priority Data

Apr. 7, 2010 (JP) ..... 2010-088527

(51) Int. Cl.
*H01R 13/40* (2006.01)

(52) U.S. Cl. ..... 439/752.5

(58) Field of Classification Search ..... 439/752.5, 439/752, 595
See application file for complete search history.

(56) References Cited

U.S. PATENT DOCUMENTS

| | | | | |
|---|---|---|---|---|
| 6,089,928 | A * | 7/2000 | Miwa et al. | 439/752 |
| 6,146,215 | A | 11/2000 | Matsushita et al. | |
| 6,461,203 | B2 * | 10/2002 | Todo | 439/752 |
| 6,589,080 | B2 * | 7/2003 | Tanaka | 439/595 |
| 6,679,738 | B2 * | 1/2004 | Nimura | 439/852 |
| 6,981,900 | B2 * | 1/2006 | Sakurai et al. | 439/752.5 |
| 7,147,522 | B2 * | 12/2006 | Kobayashi et al. | 439/852 |
| 7,204,725 | B2 * | 4/2007 | Yamashita | 439/752 |
| 7,204,728 | B2 * | 4/2007 | Noro et al. | 439/852 |
| 7,661,987 | B2 * | 2/2010 | Adachi et al. | 439/595 |
| 2004/0253881 | A1 * | 12/2004 | Sakurai et al. | 439/752 |
| 2006/0063427 | A1 * | 3/2006 | Tanaka et al. | 439/595 |
| 2007/0238353 | A1 | 10/2007 | Yamaoka | |

FOREIGN PATENT DOCUMENTS

| | | |
|---|---|---|
| EP | 1 742 300 | 1/2007 |
| WO | 98/35404 | 8/1998 |

* cited by examiner

*Primary Examiner* — Gary F. Paumen
(74) *Attorney, Agent, or Firm* — Gerald E. Hespos; Michael J. Porco

(57) ABSTRACT

A terminal fitting (10) has a rectangular tube (11) and a wire connecting portion (12) rearward of the rectangular tube (11). Two rib-like stabilizers (31F, 31R) project from the rectangular tube (11) by closely folding pieces extending from a side wall (19) of the rectangular tube (11). The stabilizers (31F, 31R ) are spaced apart in forward and backward directions. An entrance preventing portion (35) in the form of a single plate is formed between the two stabilizers (31F, 31R).

12 Claims, 6 Drawing Sheets

TERMINAL FITTING

BACKGROUND OF THE INVENTION

1. Field of the Invention

The invention relates to a terminal fitting.

2. Description of the Prior Art

U.S. Pat. No. 6,146,215 discloses a terminal fitting with a rectangular tube arranged before a wire connecting portion. Rib-like stabilizers project on an edge line of the rectangular tube and extend in forward and backward directions by closely folding plates extending from a wall of the rectangular tube. There are problems forming a stabilizer by closely folding a plate, such as difficult working and a reduction in dimensional accuracy if the length of the stabilizer increases. In this respect, the length of one stabilizer is reduced by arranging two stabilizers while spacing them apart in forward and backward directions. Thus, workability is excellent and dimensional accuracy is high upon forming the stabilizers.

However, a recess is present between the two stabilizers that are spaced apart in forward and backward directions and another member may be caught in this recess.

The invention was developed in view of the above situation and an object thereof is to prevent an external matter from being caught between adjacent stabilizers in a terminal fitting in which a plurality of stabilizers are arranged while being spaced apart.

SUMMARY OF THE INVENTION

The invention relates to a terminal fitting with: a wire connecting portion; a tube before the wire connecting portion; and stabilizers projecting like ribs from a wall of the tube. The stabilizers are spaced apart in forward and backward directions. At least one entrance preventing portion in the form of a single plate is formed between the stabilizers adjacent in forward and backward directions.

Even if an external matter tries to enter between the stabilizers adjacent in forward and backward directions, entrance is hindered by the entrance preventing portion. Thus, the external matter cannot be caught between the stabilizers.

The stabilizers preferably are formed on the tube by closely folding pieces extending from the wall.

The entrance preventing portion preferably is substantially continuous and flush with the stabilizers adjacent to and before and after the entrance preventing portion. Thus, the entrance preventing portion is reinforced and unlikely to be deformed.

A side edge of another wall different from the wall from which the stabilizers extend may be brought into contact with the wall substantially at a right angle.

Extending end edges of the stabilizers preferably are in contact with or proximate to and face a side edge portion of the other wall portion from an outer side. Thus, there is no likelihood that the wall from which the stabilizers extend and the other wall are separated. Therefore the tube retains a specified shape.

Lengths of the stabilizers in forward and backward directions preferably are longer than a distance between the stabilizers that are adjacent in forward and backward directions. Thus, there is no likelihood that stabilizers of another terminal fitting are caught between the stabilizers that are adjacent in forward and backward directions when a plurality of terminal fittings are transported or stored in a bundled state.

The entrance preventing portion preferably is connected to the stabilizers, and also to the one wall.

A projecting height of the entrance preventing portion from an extending end edge of the one wall is substantially equal to those of first flat portions of the stabilizers and shorter than the entire heights of the stabilizers.

Dimension of the front and rear stabilizers in forward and backward directions preferably are substantially equal.

At least part of the stabilizers preferably includes a first flat portion extending out from a distal end edge of the one wall, a bent portion bent inward in a width direction of the tube at the distal end edge of the first flat portion, and a second flat portion extending toward another wall from the bent portion.

The second flat portion preferably is substantially parallel to the first flat portion and an extending end edge of the second flat portion is in contact with the other wall from outside or substantially faces the other wall with a small clearance formed therebetween.

A coupling preferably is provided between the wire connecting portion and the tube. The coupling comprises a bottom wall connected to a base plate of the wire connecting portion and side walls projecting from the bottom wall at an angle and connected to at least one part of the wire connecting portion.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
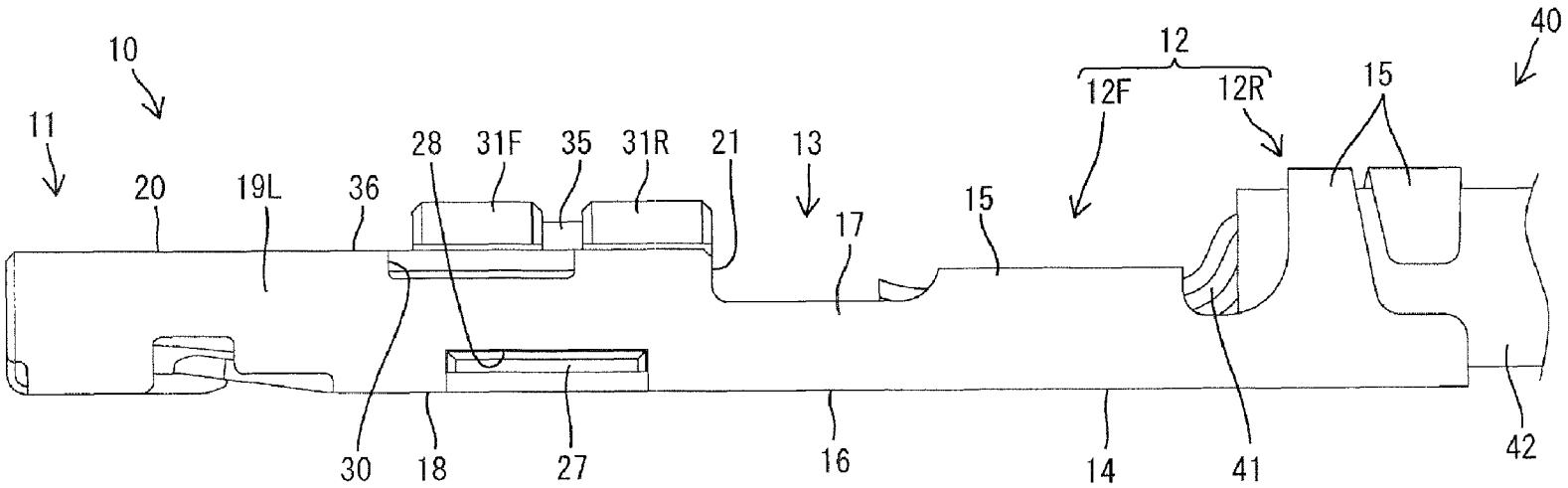
FIG. 1 is a side view of a terminal fitting according to one embodiment.

A female terminal fitting 10 in accordance with the invention is long and narrow in forward and backward directions and includes a substantially rectangular tube 11 at a front end, a wire connecting portion 12 at a rear end and a coupling 13 coupling the rectangular tube 11 and the wire connecting portion 12. The terminal fitting 10 is formed by bending, folding and/or embossing a conductive metal plate material cut out punched out into a specified shape.

The wire connecting portion 12 has a wire barrel 12F and an insulation barrel 12R connected to the rear end of the wire barrel 12F. Each of the wire barrel 12F and the insulation barrel 12R has a known open-barrel shape composed of two crimping pieces 15 projecting from opposite left and right edges of a base plate 14. A core 41 exposed at a front end portion of a wire 40 is to be electrically conductively fixed to the wire barrel 12F by crimping, folding, bending or deforming, and the front end portion of the wire 40 in an area covered by an insulation coating 42 is to be fixed to the insulation barrel 12R by crimping, folding, bending or deforming.

The coupling 13 comprises a bottom wall 16 connected to the base plate portion 14 of the wire connecting portion 12 and two side walls 17 projecting from opposite left and right edges of the bottom wall 16 at substantially right angles and connected to the crimping pieces 15 of the wire barrel 12F. Projecting distances of the side walls 17 from the bottom wall 16 particularly are shorter than the heights of sides 19L, 19R of the rectangular tube portion 11 to be described later.

The rectangular tube 11 comprises a lower wall 18 connected to the bottom wall 16 of the coupling 13, left and right) side walls 19L, 19R projecting at substantially right angles from opposite left and right sides of the lower wall 18 and an upper wall 20 extending substantially in parallel with the lower wall 18 between the upper end edges of the left and right side walls 19L, 19R to define a rectangular tube shape. The lower wall 18, the left and right side walls 19L, 19R and the upper wall 20 forming part of the rectangular tube 11 are held to constitute the rectangular tube shape by a fitting 24, an inner wall 25 and a supporting wall 26 to be described later.

The rear end of the lower wall 18 is substantially continuous and flush with the bottom wall 16 of the coupling 13, and the rear ends of the left and right side walls 19L, 19R are substantially continuous and flush with the left and right side walls 17 of the coupling 13. The projecting distances of the side walls 19L, 19R of the rectangular tube portion 11 from the lower wall 18 are longer than those of the side walls 17 of the coupling 13. Thus, a boundary part between a rear end portion of the rectangular tube 11 and a front end of the coupling 13 is stepped or offset to define a locking portion 21 at the rear end of the rectangular tube 11 for engagement by a retainer 54.

Figure 2:
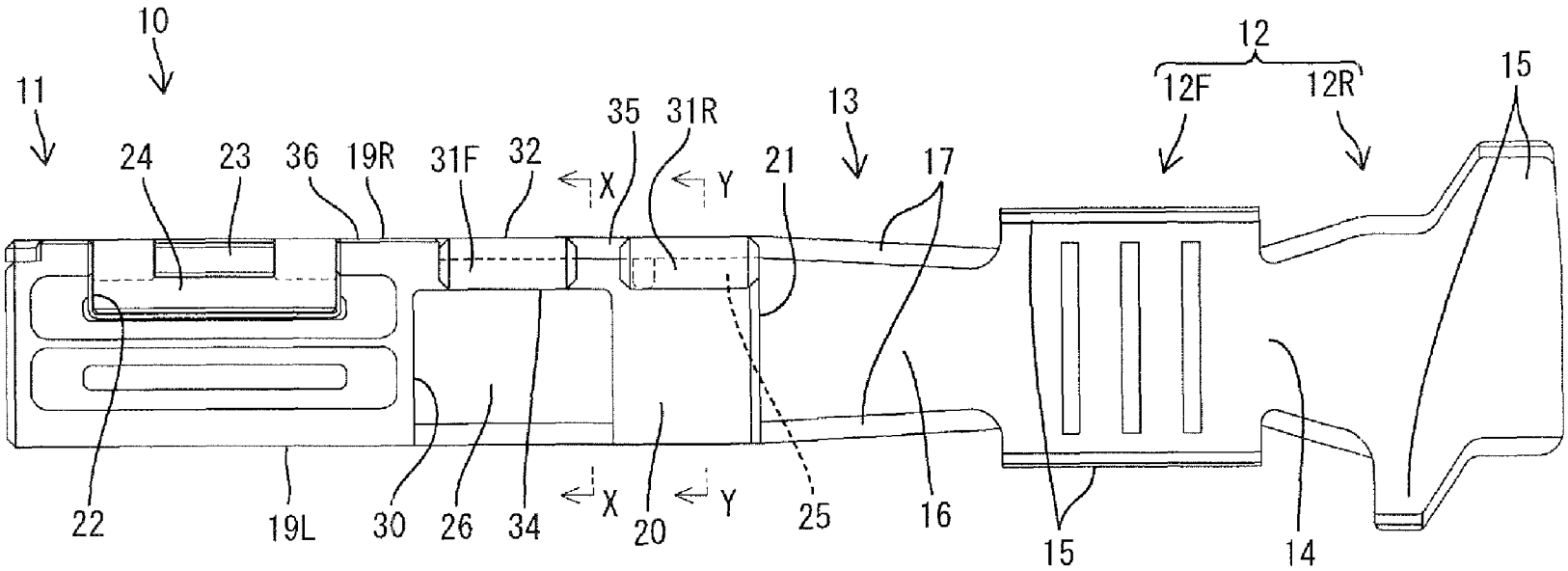
FIG. 2 is a plan view of the terminal fitting.
Figure 3:
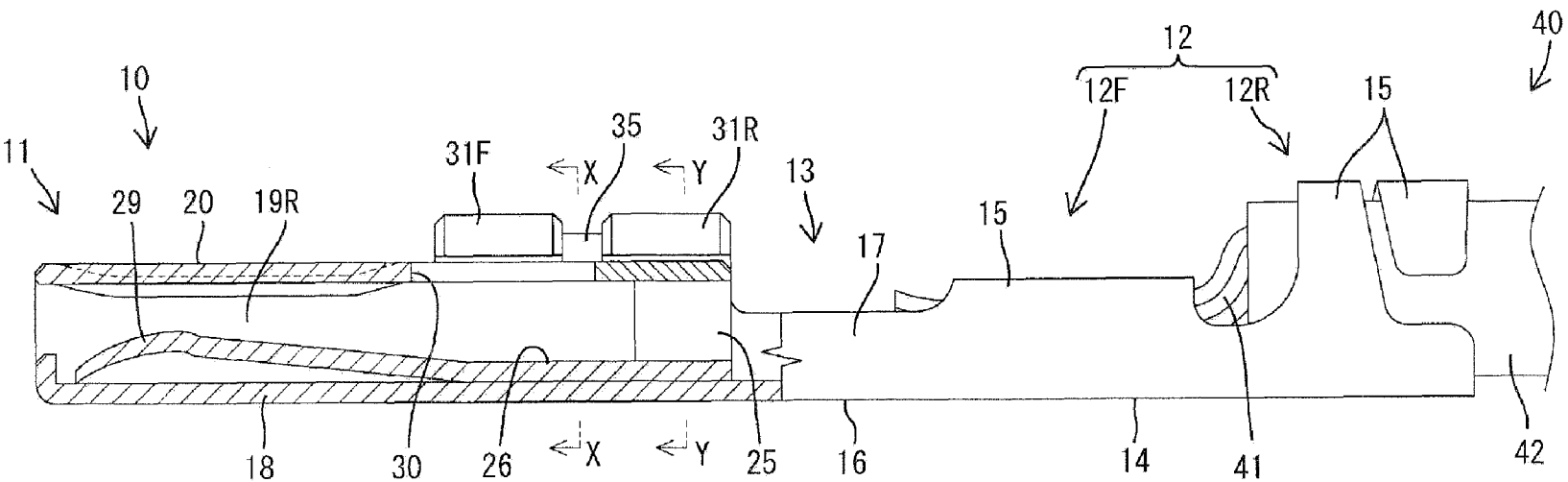
FIG. 3 is a side view partly in section of the terminal fitting.

As shown in FIG. 2, an area of the right edge of the upper wall 20 before a center in forward and backward directions is in contact with the upper end surface of the right side wall 19R from above. A substantially "V"- or "U"-shaped recess 22 is formed by slightly recessing a right edge part of an area of the upper surface of the upper wall 20 before or adjacent to the center in forward and backward directions, and a projecting part surrounded by the recess 22 defines a fitting projection 23. A substantially "V"- or "U"-shaped fitting 24 projects from the upper end edge of the right side wall 19R and engages the recess 22 and fitting projection 23 from above to prevent the upper wall 20 from being displaced up, forward, back, left and right relative to the right side wall 19R.

Figure 5:
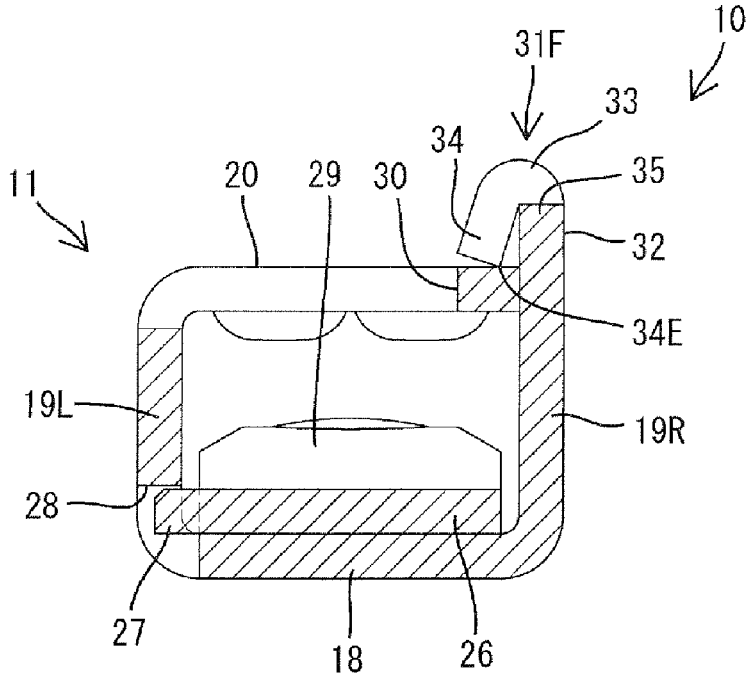
FIG. 5 is a section along X-X of FIGS. 2 and 3.
Figure 6:
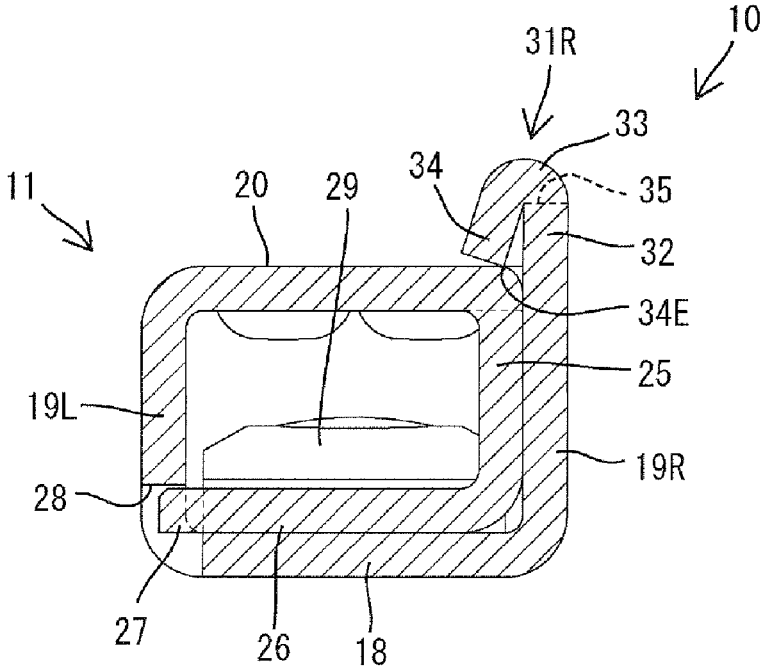
FIG. 6 is a section along Y-Y of FIGS. 2 and 3.
Figure 7:
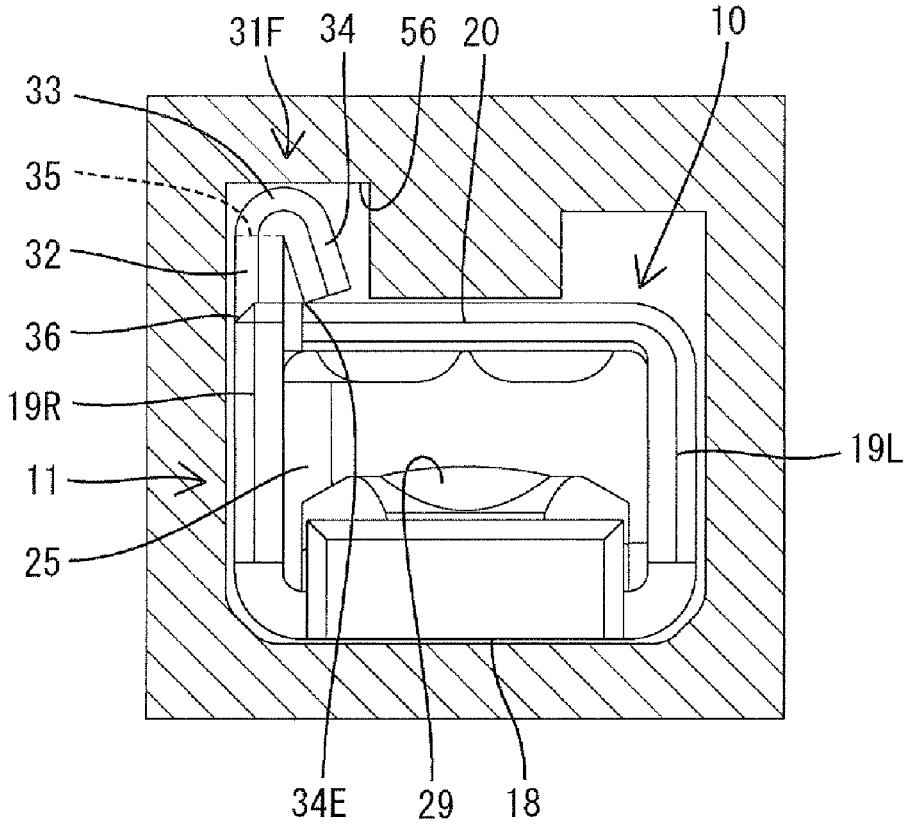
FIG. 7 is a section along Z-Z of FIG. 4.

An area of the right edge of the upper wall 20 behind or adjacent to the center in forward and backward directions contacts an upper end portion of the inner surface of the right side wall 19R from the left as shown in FIG. 5. As shown in FIG. 6, an inner wall 25 extends down along the inner surface of the right side wall 19R from a rear end portion of the right edge of the upper wall 20. A supporting wall 26 extends left along the upper surface of the lower wall 18 from the lower end edge of the inner wall 25. The left end edge of the supporting wall 26 is substantially in contact with the left side wall 19L, and a locking projection 27 formed at the left edge of the supporting wall 26 is to be engaged with a locking hole 28 of the left side wall 19L. The upper wall 20 is prevented from being displaced down, left and/or right relative to the left and right side walls 19L, 19R and the lower wall 18 by the inner walls 25 and supporting wall 26. A resilient contact piece 29 to be resiliently brought into contact with a tab of a mating male terminal (not shown) when the tab is inserted into the rectangular tube 11 is cantilevered substantially forward from the front end edge of the supporting wall 26 while being spaced from the lower wall 18.

A substantially rectangular opening is formed in an area of the upper wall 20 of the rectangular tube 11 slightly behind or adjacent to the center in forward and backward directions to form a retaining hole 30. The retaining hole 30 penetrates from the outer surface to the inner surface of the upper wall 20, and a locking lance 52 to be described later is to be engaged with the retaining hole 30. As shown in FIG. 2, the position of the retaining hole 30 in forward and backward directions is before or adjacent to the inner wall 25 and the supporting wall 26 for preventing relative displacements of the upper wall 20 and behind the fitting 24.

Figure 4:
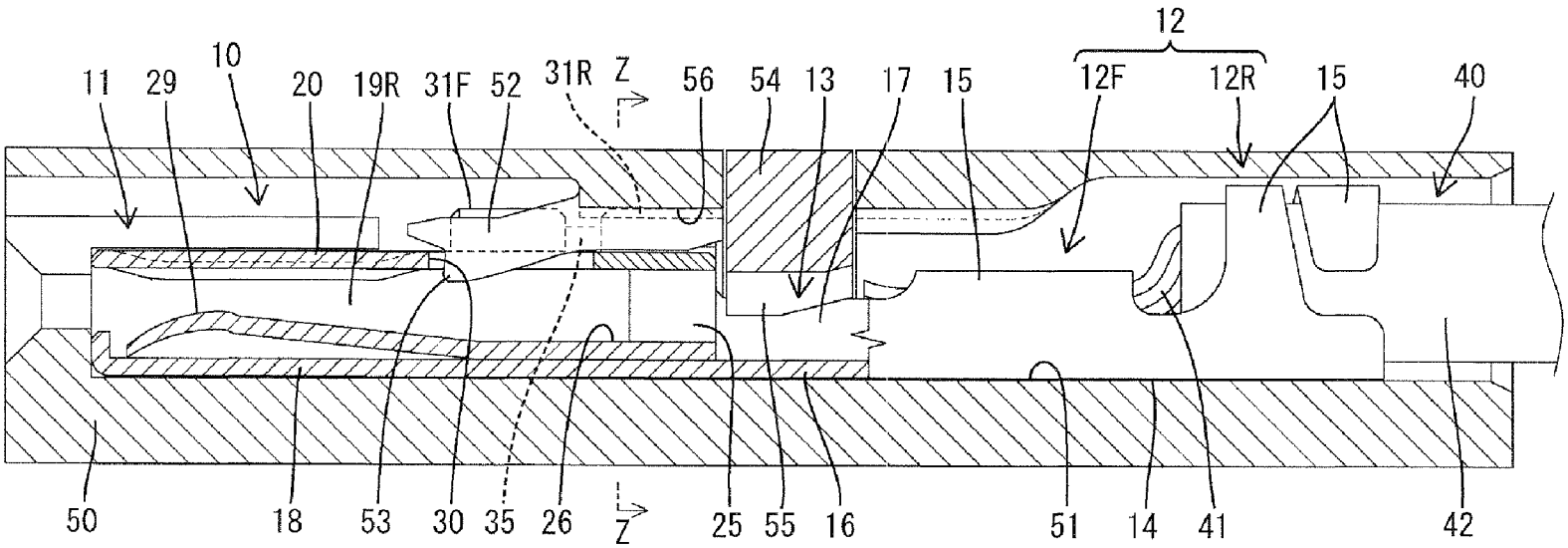
FIG. 4 is a section showing a state where the terminal fitting is inserted in a connector housing.

The terminal fitting 10 is to be inserted into a cavity 51 in a connector housing 50 from behind. The locking lance 52 is cantilevered substantially forward along the upper wall surface of the cavity 51. The locking lance 52 normally is held at a locking position shown in FIG. 4 due to the rigidity of the locking lance 52 itself, but is resiliently displaceable from the locking position to an unlocking position offset from the cavity 51. A retaining projection 53 is formed on the inner surface of the locking lance 52. The retaining projection 53 interferes with the upper surface of the tube 11 in the process of inserting the terminal fitting 10 into the cavity 51 and the locking lance 52 is displaced to the unlocking position. The locking lance 52 restores resiliently when the terminal fitting 10 is inserted properly so that the retaining projection 53 engages the retaining hole 30 and retains the terminal fitting 10.

The retainer 54 is mounted in the connector housing 50 for retaining the terminal fitting 10 in addition to the locking lance 52. The retainer 54 includes a retaining portion 55 located in the cavity 51 and is substantially displaceable up and down between a full locking position shown in FIG. 4 and a partial locking position reached by being retracted up in FIG. 4 to permit insertion of the terminal fitting 10 into the cavity 51. When the retainer 54 is moved to the full locking position with the terminal fitting 10 properly inserted, the retaining portion 55 engaged the locking portion 21 of the terminal fitting 10 to retain the terminal fitting 10.

The tube 11 is formed with two stabilizers 31F, 31R projecting up like ribs from the outer surface of the rectangular tube 11 for preventing the terminal fitting 10 from being inserted in an improper posture (e.g. a vertically inverted posture) when the terminal fitting 10 is inserted into the housing 50 to be described later. The stabilizers 31F, 31R are arranged substantially along an upper right corner edge 36 of the tube 11 that extends in forward and backward directions while being spaced apart in forward and backward directions. A groove 56 is formed along the ceiling wall of the cavity 51 in the connector housing 50 for allowing entrance of the stabilizers 31F, 31R when the terminal fitting 10 is inserted into the cavity 51 in a proper posture.

The stabilizers 31F, 31R are arranged in an area of the rectangular tube 11 behind or adjacent to the center in forward and backward directions (area where the right end edge of the upper wall 20 contacts the inner surface of the right side wall 19R). As shown in FIG. 2, the front stabilizer 31F is in an area substantially corresponding to the retaining hole 30 in forward and backward directions and the rear stabilizer 31R is in an area substantially corresponding to the inner wall 25 in forward and backward directions.

As shown in FIGS. 5 and 6, each of the stabilizers 31F, 31R includes a first flat portion 32 extending up from the upper edge of the right side wall 19R and/or substantially flush with the right side wall 19R, a bent portion 33 is bent to the left (inwardly in a width direction of the rectangular tube 11 at the upper end of the first flat portion 32 while forming a substantially semicircular arch, and a second flat portion 34 extends down toward the upper wall 20 from the bent portion 33. The second flat portion 34 particularly is substantially parallel (i.e. slightly inclined) to the left surface of the first flat portion 32 and an extending end edge 34E (lower end edge) of the second flat portion 34 is in contact with the upper surface of the right edge portion of the upper wall 20 from above or substantially faces this upper surface with a small clearance therebetween.

If the two stabilizers 31F, 31R are arranged while being spaced apart in forward and backward directions in this way, a recessed part is present between these two stabilizers 31F, 31R and another member may be caught in this recessed part. Accordingly, an entrance preventing portion 35 is formed unitarily to the rectangular tube 11 for preventing another member from being caught. The entrance preventing portion 35 extends up from the upper end of the right side wall 19R, from which the stabilizers 31F, 31R are formed, and is substantially flush with the right side wall 19R particularly in the form of a single plate. The front end of the entrance preventing portion 35 is substantially continuous and flush with the first flat portion 32 of the front stabilizer 31F, and the rear end thereof is substantially continuous and flush with the first flat portion 32 of the rear stabilizer 31R.

As shown in FIGS. 1, 5 and 6, a projecting height of the entrance preventing portion 35 from the extending end edge of the right side wall 19R (upper surface of the rectangular tube 11) is substantially equal to projecting heights of the first flat portions 32 of the stabilizers 31F, 31R, but is shorter than the entire heights of the stabilizers 31F, 31R (heights of the highest parts of the bent portions 33). Further, a dimension of the front stabilizer 31F in forward and backward directions and that of the rear stabilizer 31R are substantially equal, and a distance between the two stabilizers 31F, 31R in forward and backward directions is less than the length of one stabilizer 31F, 31R in forward and backward directions. Further, the distance between the stabilizers 31F and 31R in forward and backward directions particularly is less than the length of the retaining portion 55 of the retainer 54 in forward and backward directions.

As described above, the rectangular tube 11 is provided before the wire connecting portion 12 and the front and rear stabilizers 31F, 31R and are formed by closely folding plates extending from the right side wall 19R of the rectangular tube 11 and project like ribs on the edge line 36 of the rectangular tube 11 while being spaced apart in forward and backward directions. The entrance preventing portion 35 is a single plate that extends from the right side wall 19R of the rectangular tube 11 and is between the two stabilizers 31F, 31R that are adjacent in forward and backward directions. Accordingly, even if external matter tries to enter between the stabilizers 31F, 31R that are adjacent in forward and backward directions, entrance is hindered by the entrance preventing portion 35, wherefore external matter will not be caught between the stabilizers 31F, 31R.

The entrance preventing portion 35 is substantially continuous and flush with the first flat portions 32 of the stabilizers 31F, 31R adjacent to and before and after the entrance preventing portion 35. Thus, the entrance preventing portion 35 is reinforced and unlikely to be deformed. Further, the entrance preventing portion 35 is connected to the stabilizers 31F, 31R and also to the right side wall 19R so that the strength of the entrance preventing portion 35 is increased. Thus, external matter will not be caught between the stabilizers 31F, 31R. Further, since the entrance preventing portion 35 is a single flat plate and need not be bent, the production of the terminal fitting 10 can be simplified.

The edge line 36 on which the stabilizers 31F, 31R are arranged is formed by bringing the right edge of the upper wall 20 into contact with the right side wall 19R, from which the stabilizers 31F, 31R extend, and the extending end edges 34E of the stabilizers 31F, 31R are in contact with or proximate to and substantially face the right edge portion of the upper wall 20 from the outer side. If the upper wall portion 20 is pressed by the extending end edges 34E of the stabilizers 31F, 31R from the outer side in this way, there is no likelihood that the upper wall 20 is displaced up to form a clearance in the edge line 36. Therefore the rectangular tube 11 is retained in the specific shape. Particularly, in this embodiment, the extending end edge 34E of the front stabilizer 31F effectively presses an area of the upper wall portion 20 where rigidity is reduced due to the formation of the retaining hole 30.

The lengths of the stabilizers 31F, 31R in forward and backward directions are longer than the distance between the stabilizers 31F, 31R adjacent in forward and backward directions. Thus, there is no likelihood that stabilizers 31F, 31R of another terminal fitting 10 are caught between the stabilizers 31F, 31R adjacent in forward and backward directions when terminal fittings 10 are transported or stored in a bundled state.

The invention is not limited to the above described and illustrated embodiment. For example, the following embodiments are also included in the technical scope of the present invention.

Although the entrance preventing portion and the stabilizers adjacent to and before and after the entrance preventing portion particularly substantially are continuous and flush with each other in the above embodiment, they may not be directly connected and small clearances may be formed between the entrance preventing portion and the stabilizers instead.

Although the first flat portions at the base sides of the stabilizers are continuous and flush with the wall from which the stabilizers extend in the above embodiment, the first flat portions may be bent substantially at right angles to the wall from which the stabilizers extend.

Although two stabilizers are provided in the above embodiment, three or more stabilizers may be provided. In this case, at least two or more entrance preventing portions are or may be provided.

Although the entrance preventing portion and the stabilizers adjacent to and before and after the entrance preventing portion extend from the common wall (right side wall portion) in the above embodiment, they may extend from different wall portions.

Although one entrance preventing portion is provided between the two adjacent stabilizers in the above embodiment, a plurality of entrance preventing portions may be provided between the two adjacent stabilizers.

Although the extending end edges of the stabilizers are in contact with or proximate to and face the side edge portion of the other wall portion (upper wall portion) different from the wall portion (right side wall portion), from which the stabilizers extend, out of a plurality of wall portions constituting or forming part of the rectangular or polygonal tube portion from the outer side in the above embodiment, they may be at a large distance from and/or substantially face the side edge portion of the wall portion (upper wall portion) different from the other wall portion (right side wall portion) from which the stabilizers extend or may not substantially face the other wall portion (upper wall portion).

Although the lengths of the stabilizers in forward and backward directions are longer than the distance between the stabilizers adjacent in forward and backward directions in the above embodiment, they may be substantially equal to or smaller than the distance between the stabilizers adjacent in forward and backward directions.

Although the lengths of the stabilizers in forward and backward directions are longer than the length of the entrance preventing portion in forward and backward directions in the above embodiment, they may be substantially equal to or smaller than the length of the entrance preventing portion in forward and backward directions.

Although the dimensions of the front and rear stabilizers in forward and backward directions are substantially equal in the above embodiment, they may differ from each other.

Although the projecting distance of the entrance preventing portion from the outer surface (edge line) of the rectangular tube is shorter than those of the stabilizers in the above embodiment, it may be equal to the projecting distances of the stabilizers.

Although the entrance preventing portion substantially extends from the right side wall portion constituting or forming part of the rectangular or polygonal tube portion in the above embodiment, it may be continuous only with the stabilizers without extending from the wall portion constituting the rectangular tube or polygonal portion.

Although the female terminal fitting, into the rectangular or polygonal tube portion of which the tab of the mating terminal is to be inserted, is illustrated in the above embodiment, the present invention is also applicable to a male terminal fitting including a tab substantially projecting forward from a rectangular or polygonal tube portion.

What is claimed is:

1. A terminal fitting, comprising:

a wire connecting portion;

a tube provided forward the wire connecting portion and having a first wall;

front and rear rib-shaped stabilizers projecting from the tube and being spaced apart in forward and backward directions, each of the front and rear stabilizers having a first flat panel projecting out from the tube at a position aligned with the first wall and a second panel bent from an outer end of the first panel back toward the tube; and an entrance preventing portion in the form of a single plate being formed between the first panels of the front and rear stabilizers.

2. The terminal fitting of claim 1, wherein the entrance preventing portion is substantially continuous and flush with the first panels of the front and rear stabilizers.

3. The terminal fitting of claim 1, wherein the tube further has a second wall, a side edge of the second wall being brought into contact with the first wall at a substantially right angle.

4. The terminal fitting of claim 3, wherein the second panels of the front and rear stabilizers have extending end edges that are in contact with or proximate to and face a side edge of the second wall from an outer side.

5. The terminal fitting of claim 3, wherein the first flat panel of each of the stabilizers extends out from a distal end edge of the first wall , a bend bent inwardly in a width direction of the tube at a distal end of the first flat panel, and the second flat panel extending from the bend back toward second wall of the tube.

6. The terminal fitting of claim 5, wherein the second flat panel is substantially parallel to the first flat panel and an extending end edge of the second flat panel is in contact with the second wall portion from outside or substantially faces the second wall with a small clearance formed therebetween.

7. The terminal fitting of claim 1, wherein lengths of the stabilizers in forward and backward directions exceed a distance between the stabilizers that are adjacent in forward and backward directions.

8. The terminal fitting of claim 1, wherein the entrance preventing portion (35) is connected unitarily to the first panels of both of the stabilizers and the first wall.

9. The terminal fitting of claim 6, wherein a projecting height of the entrance preventing portion from an extending end edge of the first wall is substantially equal to heights of first flat panels of the stabilizers and shorter than entire heights of the stabilizers.

10. The terminal fitting of claim 1, wherein dimensions of the front and rear stabilizers in forward and backward directions are substantially equal.

11. The terminal fitting of claim 1, wherein a coupling is provided between the wire connecting portion 12 and the tube.

12. The terminal fitting of claim 11, wherein the coupling comprises a bottom wall connected to a base plate of the wire connecting portion and side walls projecting at an angle from the bottom wall and connected to at least one part of the wire connecting portion.

* * * * *